US006939161B1

(12) United States Patent
Yi et al.

(10) Patent No.: US 6,939,161 B1
(45) Date of Patent: Sep. 6, 2005

(54) METHODS AND APPARATUS FOR SECURING A CABLE CONNECTOR TO A DEVICE

(75) Inventors: George Youzhi Yi, Fremont, CA (US); Tracy Winn, Mountain View, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/706,519

(22) Filed: Nov. 12, 2003

(51) Int. Cl.[7] ..... H01R 13/62
(52) U.S. Cl. ..... 439/373
(58) Field of Search ..... 439/373, 353, 439/371

(56) References Cited

U.S. PATENT DOCUMENTS 5,589,665 A 12/1996 Scamacca ..... 174/67
5,989,052 A * 11/1999 Fields et al. ..... 439/373
6,375,487 B1 * 4/2002 Tennessen ..... 439/373
6,767,237 B1 * 7/2004 Shih ..... 439/371

* cited by examiner

*Primary Examiner*—Phuong Dinh
(74) *Attorney, Agent, or Firm*—David E. Huang, Esq.

(57) ABSTRACT

A connection system has a device, and a cable assembly having a cable and a cable connector disposed at an end of the cable. The cable connector is configured to connect to the device. The connection system further includes a retaining clip configured to secure the cable connector to the device when the cable connector connects to the device. The retaining clip includes a main body defining a cavity and a central axis which extends through the cavity. The main body is configured to receive and hold the cable connector. The retaining clip further includes a set of latching arms attached to the main body. Each latching arm extends in a direction substantially parallel to the central axis and is configured to latch the main body to the device when the main body receives and holds the cable connector and when the cable connector connects to the device.

27 Claims, 6 Drawing Sheets

METHODS AND APPARATUS FOR SECURING A CABLE CONNECTOR TO A DEVICE

BACKGROUND

A typical network router includes a set of ports for connecting to a network, electronic circuitry and a power supply. When the power supply provides power to the electronic circuitry, the electronic circuitry gathers configuration information from the network (e.g., from one or more other network devices), and routes data (e.g., packets) between the ports based on the gathered configuration information.

There are a variety of ways for a manufacturer to equip the network router with the power supply. In one approach (hereinafter called the internal approach), the manufacturer designs the network router so that the power supply is internal to (or installed within) the same enclosure that houses the electronic circuitry. This approach enables the power supply to enjoy the same protective benefits as that of the electronic circuitry, e.g., cooling from an internal fan assembly, protection against being inadvertently damaged by objects moving in the vicinity of the network router, security against tampering, etc.

In another approach (hereinafter called the external approach), the manufacturer designs the network router so that the power supply is external to the enclosure that houses the electronic circuitry. Here, the manufacturer provides the electronic circuitry with a power supply connector (e.g., a female power jack which is flush with the enclosure of the electronic circuitry). The manufacturer further provides a "brick on a rope" type external power supply assembly. This power supply assembly includes a power supply cable, a power supply connector at one end of the cable (e.g., a male power jack which is configured to engage the female power jack of the electronic circuitry), and a transformer further down the cable. There are a variety of standard power supply connectors which are well-suited for this approach such as conventional 5.5×2.1 mm DC power connectors, 3.4×1.3 mm DC power connectors, EIAJ plugs, Barrel or Bayonette style plugs, etc.

In the external approach, the use of such "brick on a rope" type power supply assemblies alleviates the need for manufacturers to install internal power supplies in network routers. Rather, manufacturers of the network routers simply include separate pre-tested, off-the-shelf power supplies with the network routers and perhaps perform less extensive testing. Accordingly, at setup time, users of the network routers simply connect the electronic circuitry with the power supply assembly through the power supply connectors. This approach provides several operational advantages such as lowering the power dissipation requirements and the footprint (i.e., size) of the main electronic circuitry enclosure since the power supply is now external from the main electronic circuitry enclosure, as well as providing a safer operating environment since the main electronic circuitry enclosure connects to a relatively safer lower voltage source (e.g., 5 VDC, 12 VDC, etc.) rather than a larger source (e.g., 110 VAC, 240 VAC, etc.). Furthermore, this approach enables the manufacturer to reduce manufacturing costs (e.g., the manufacturer saves money by eliminating costs associated with installing a power supply internally).

In yet another approach (hereinafter called the custom locking approach), the manufacturer equips both electronic circuitry of a network router and an external power supply assembly with customized locking connectors. Users of such network routers can connect the external power supply assembly to the electronic circuitry in a reliable manner thus reducing the risk of activity in the vicinity of the network router (e.g., movement by a cleaning person) inadvertently disconnecting the external power supply assembly from the electronic circuitry. Additionally, the users have the capability to later purposefully disconnect the external power supply assembly from the electronic circuitry if necessary (e.g., to move the network router to a new location at a conveniently scheduled time).

SUMMARY

Unfortunately, there are deficiencies to the above-described conventional approaches to equipping network routers with power supplies. For example, in the above-described conventional internal approach, manufacturers must provide larger enclosures (i.e., enclosures with larger footprints and larger cooling assemblies to handle power dissipation of the internal power supplies) as well as incur the additional costs of installing the internal power supplies. Unlike the external approach, the manufacturers using the internal approach do not have the flexibility of using off-the-shelf external power supplies and the earlier-described associated cost benefits.

Additionally, in the above-described conventional external approach, a user of the network router runs the risk of inadvertently disconnecting the external power supply assembly from the electronic circuitry. In particular, once a user connects the external power supply assembly to the electronic circuitry and the electronic circuitry is in operation, activity in the vicinity of the cable or connector of the power supply assembly may inadvertently cause disconnection of the power supply connectors thus depriving the electronic circuitry of its power source. For example, a cleaning person vacuuming around the network router could accidentally pull on the power supply cable causing the power supply cable connector to disconnect from the electronic circuitry. In many cases, the network router does not have an alternative source of power (e.g., no battery backup) and thus the network router stops operating resulting in lost data. In such cases, even if the disconnection is quickly detected and fixed (e.g., even if the cleaning person immediately reconnects the power supply connectors), the equipment using the network router may need to perform an extensive recovery operation to recover lost data and a significant amount of time may be required for the network router to reacquire configuration information and return to the operating state it was in prior to the disconnection. Accordingly, any disconnection of the external power supply risks a substantial loss of service. Such a loss of service may translate into complaints to the manufacturer, and perhaps loss of goodwill and/or loss of the manufacturer's reputation for providing quality equipment.

Furthermore, in the above-described conventional custom locking approach, the manufacturer must incur the additional costs of incorporating customized locking connectors into the equipment of the network router. In particular, the manufacturer must specially design both the electronic circuitry and the external power supply assembly with custom locking connectors. Since the supplier of the power supply assemblies must provide power supplies with special custom locking connectors, the power supply assemblies tend to be more expensive compared to higher volume, off-the-shelf power supplies which use standard non-locking power supply connectors. Accordingly, the custom locking approach precludes the manufacturer from using less expensive and more available off-the-shelf components such as common brick-on-a-rope type power supplies.

In contrast to the above-described conventional approaches to equipping network routers with power supplies, embodiments of the invention are directed to techniques for securing a cable connector to a device using a retaining clip. In the context of a network router, the use of such a retaining clip enables a manufacturer to provide network routers with external power supplies, as well as enables users to reliably secure the external power supplies to electronic equipment of the network routers thus reducing the likelihood of inadvertently disconnecting the external power supplies from the electronic equipment.

One embodiment of the invention is directed to a connection system which includes a device (e.g., electronic circuitry of a network router), and a cable assembly (e.g., a power supply assembly). The cable assembly has a cable and a cable connector disposed at an end of the cable. The cable connector is configured to connect to the device. The connection system further includes a retaining clip configured to secure the cable connector to the device when the cable connector connects to the device. The retaining clip has a main body defining a cavity and a central axis which extends through the cavity. The main body is configured to receive and hold the cable connector. The retaining clip further has a set of latching arms attached to the main body. Each latching arm extends in a direction substantially parallel to the central axis and is configured to latch the main body to the device when the main body receives and holds the cable connector and when the cable connector connects to the device. Accordingly, the retaining clip is configured to robustly attach the cable connector to the device thus reducing the possibility of an undesired disconnection.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the invention are directed to techniques for securing a cable connector to a device using a retaining clip. This retaining clip enables an equipment manufacturer to provide the device with an external cable assembly (e.g., "brick on a rope" type power supply assembly) so that a user can secure a cable connector of the external cable assembly to the device without concern that the cable connector will inadvertently disconnect from the device. The use of such a clip, which can be provided by the manufacturer as a low-cost accessory, prevents accidental and costly disconnection (e.g., loss of power) of external cable assembly and the electronic device.

Figure 1:
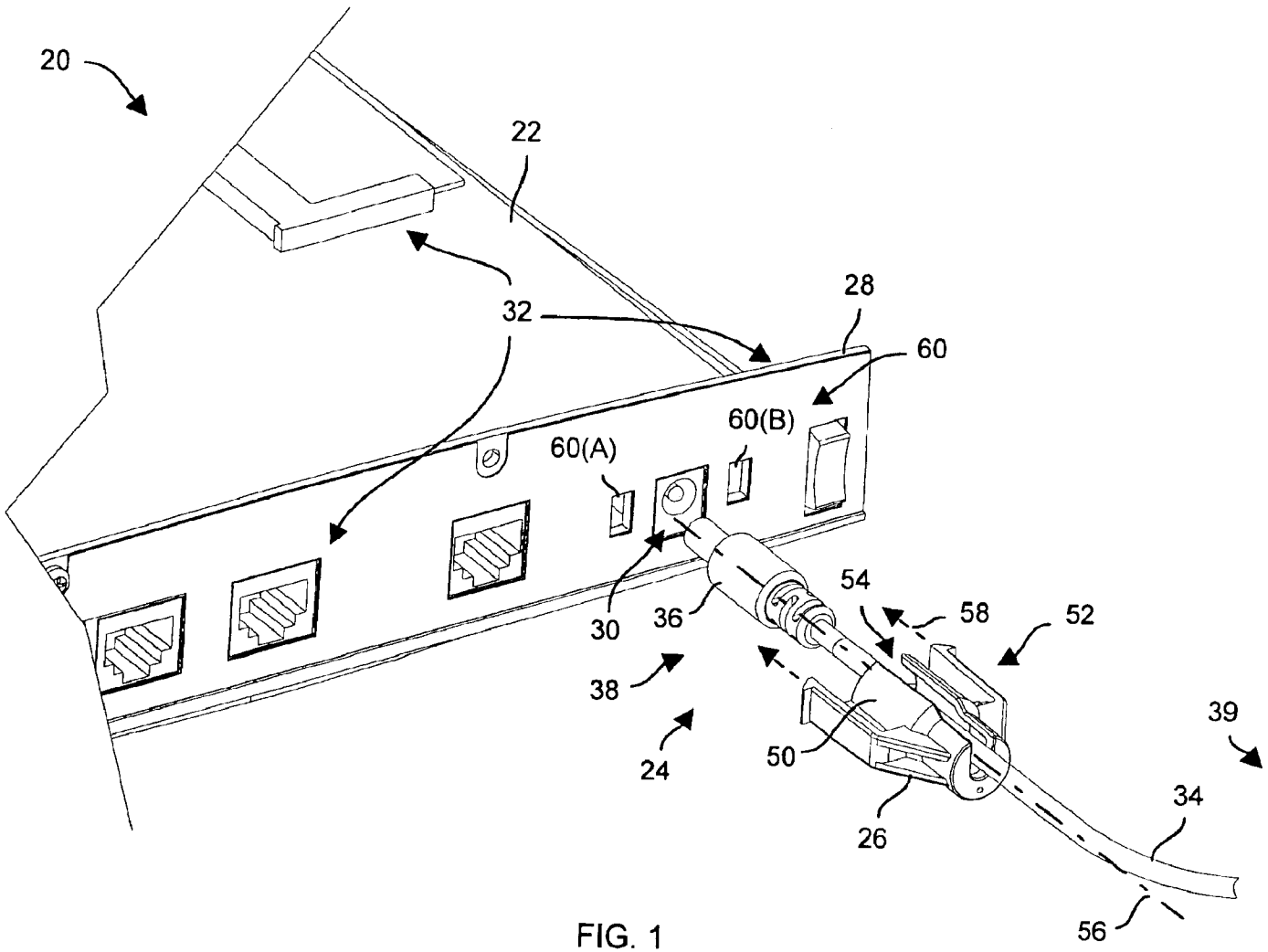
FIG. 1 is a perspective view of a connection system which is suitable for use by the invention while the connection system is in a disconnected state.
Figure 2:
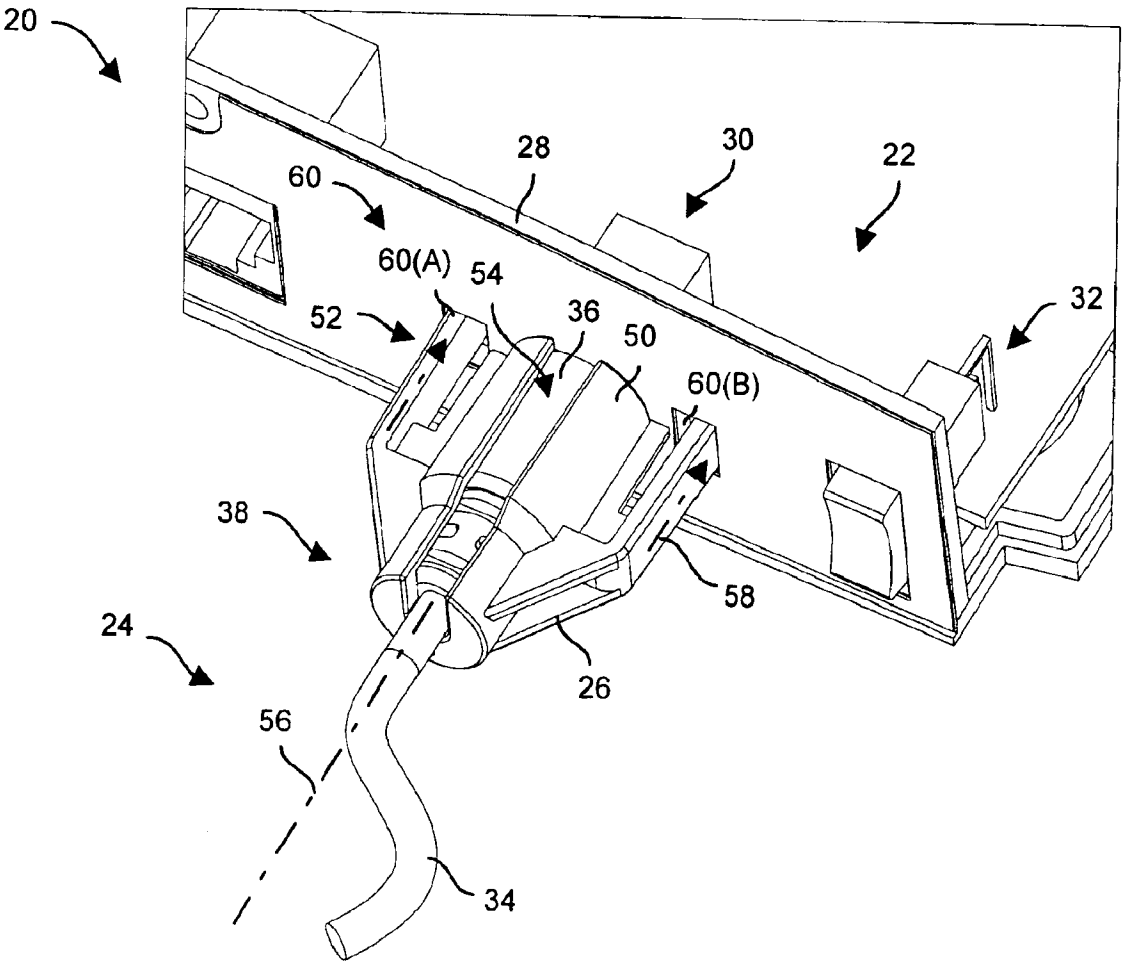
FIG. 2 is a perspective view of the connection system of FIG. 1 when the connection system is in a connected state.

FIGS. 1 and 2 show a connection system 20 which is suitable for use by the invention. In FIG. 1, the connection system 20 is in a disconnected state. In FIG. 2, the connection system 20 is in a connected state.

The connection system 20 includes a device 22, a cable assembly 24, and a retaining clip 26. The device 22 includes a rigid planar member 28 (e.g., a housing or chassis wall, a printed circuit board, etc.), a device connector 30, and electronic circuitry 32. Both the device connector 30 and the electronic circuitry 32 are physically coupled to the rigid planar member 28. Additionally, the device connector 30 and the electronic circuitry 32 are in electrical communication with each other thus enabling the device connector 30 to operate as an electrical interface, i.e., to allow one or more signals to pass between the electronic circuitry 32 and the cable assembly 24.

As shown in both FIGS. 1 and 2, the cable assembly 24 includes a cable 34 and a cable connector 36 disposed at an end 38 of the cable 34. The cable connector 36 is configured to connect with and disconnect from the device connector 30.

By way of example only, the device 22 is a data communications device (e.g., a router), an the electronic circuitry 32 is configured to transfer data (e.g., packets) between a set of ports. Particular components of the electronic circuitry 32 (e.g., an ON/OFF switch, data communications ports, integrated circuits) are shown pictorially in FIG. 1. In this example, the rigid planar member 28 is a side of an enclosure which houses the electronic circuitry 32. Additionally, the device connector 30 is a standard coaxial DC power supply jack (e.g., a female 5.5×2.1 mm DC power connector, a female 3.4×1.3 mm DC power connector, etc.) which is flush with the side of the rigid planar member. Furthermore, the cable assembly 24 is a DC power supply assembly with a transformer 39 (shown generally by the arrow 39 in FIG. 1) installed along the cable 34 (e.g., a "brick on a rope" type power supply assembly). Accordingly, when a user connects the transformer into a main power source (e.g., a standard 120 VAC wall outlet), and further connects the cable connector 36 (e.g., (e.g., a male 5.5×2.1 mm DC power connector, a male 3.4×1.3 mm DC power connector, etc.) to the device connector 30 (see FIG. 2), the cable assembly 24 provides a DC power supply input (e.g., 5 VDC, 9 VDC, 12 VDC, 18 VDC, etc.) to the electronic circuitry 32 through tie device connector 30 to enable the electronic circuitry 32 to perform data communication operations.

As further shown in both FIGS. 1 and 2, the retaining clip 26 includes a main body 50 and a set of latching arms 52 which is attached to the main body 50. The main body 50 defines a cavity 54 and a central axis 56 which extends through the cavity 54. The main body 50 is configured to capture the cable connector 36 within the cavity 54 (e.g., see FIG. 2). Each latching arm 52 extends in a direction 58 substantially parallel to the central axis 56 and is configured to latch the main body 50 to the device 22 when the main body 50 receives and holds the cable connector 36 and when the cable connector 36 connects to the device 22. In particular, each latching arm 52 inserts through a corresponding aperture 60(A), 60(B) (collectively, apertures 60) defined in the rigid planar member 28, and then latches onto the rigid planar member 28 (e.g., in a snap fit manner). In this situation, the retaining clip 24 robustly secures the cable connector 36 to the rigid planar member 28 of the device 22 (FIG. 2) in a board-mount or panel-mount manner.

It should be understood that, in contrast to a conventional external approach in which an external power supply can be easily accidentally disconnected, the retaining clip 24 of the connection system 20 inhibits accidental disconnection of the cable assembly 24 (e.g., an external power supply assembly). Additionally, in contrast to a conventional custom locking approach which uses custom locking connectors, a manufacturer of the connection system 20 is capable of providing a common off-the-shelf external power supply, as the cable assembly 24, which the manufacturer may perhaps obtain at a lower, more competitive price while still providing a connection system 20 which is not prone to accidental disconnection. Further details of the invention will now be provided with reference to FIGS. 3 and 4.

Figure 3:
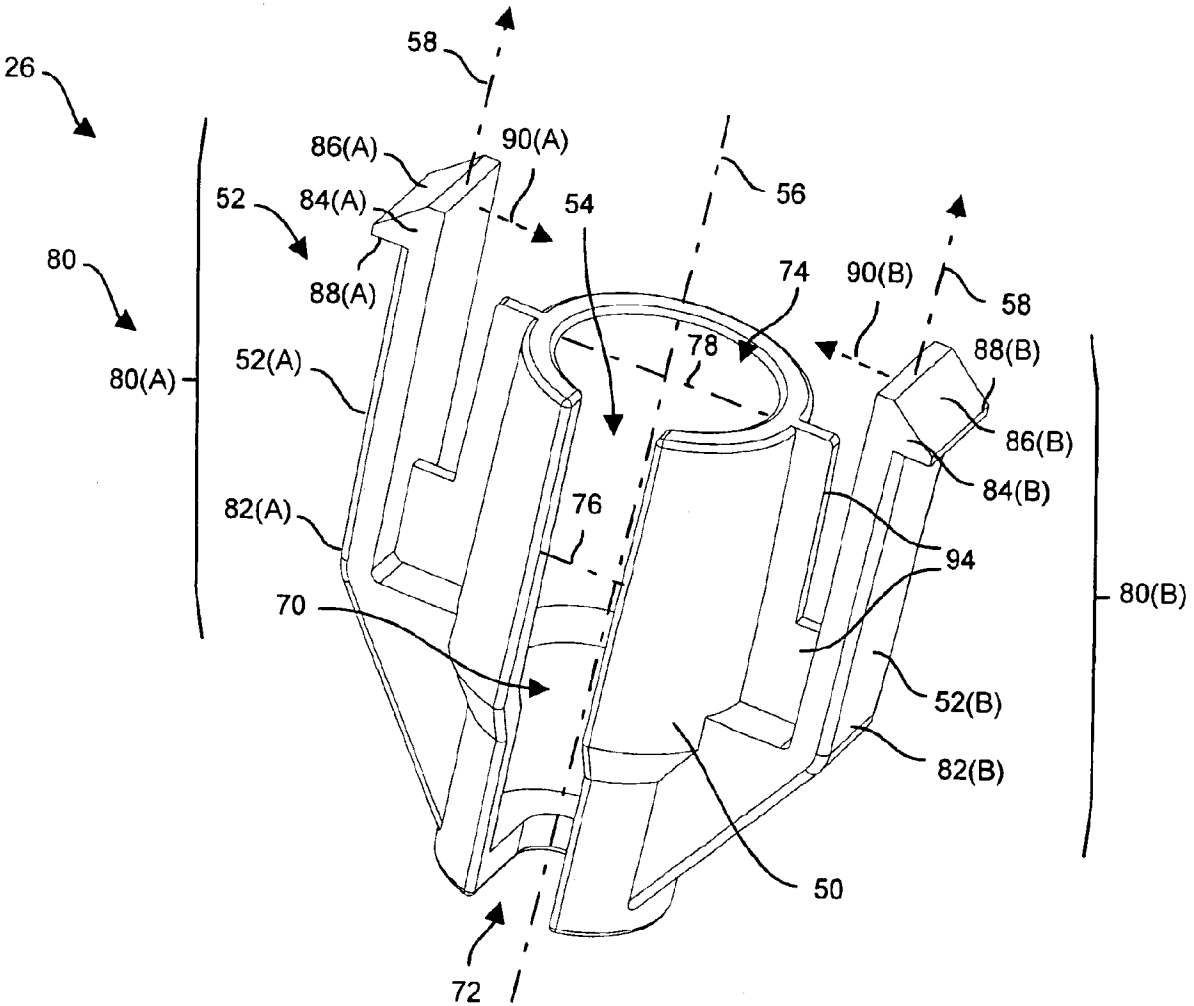
FIG. 3 is a detailed perspective view of a retaining clip of the connection system of FIGS. 1 and 2.
Figure 4:
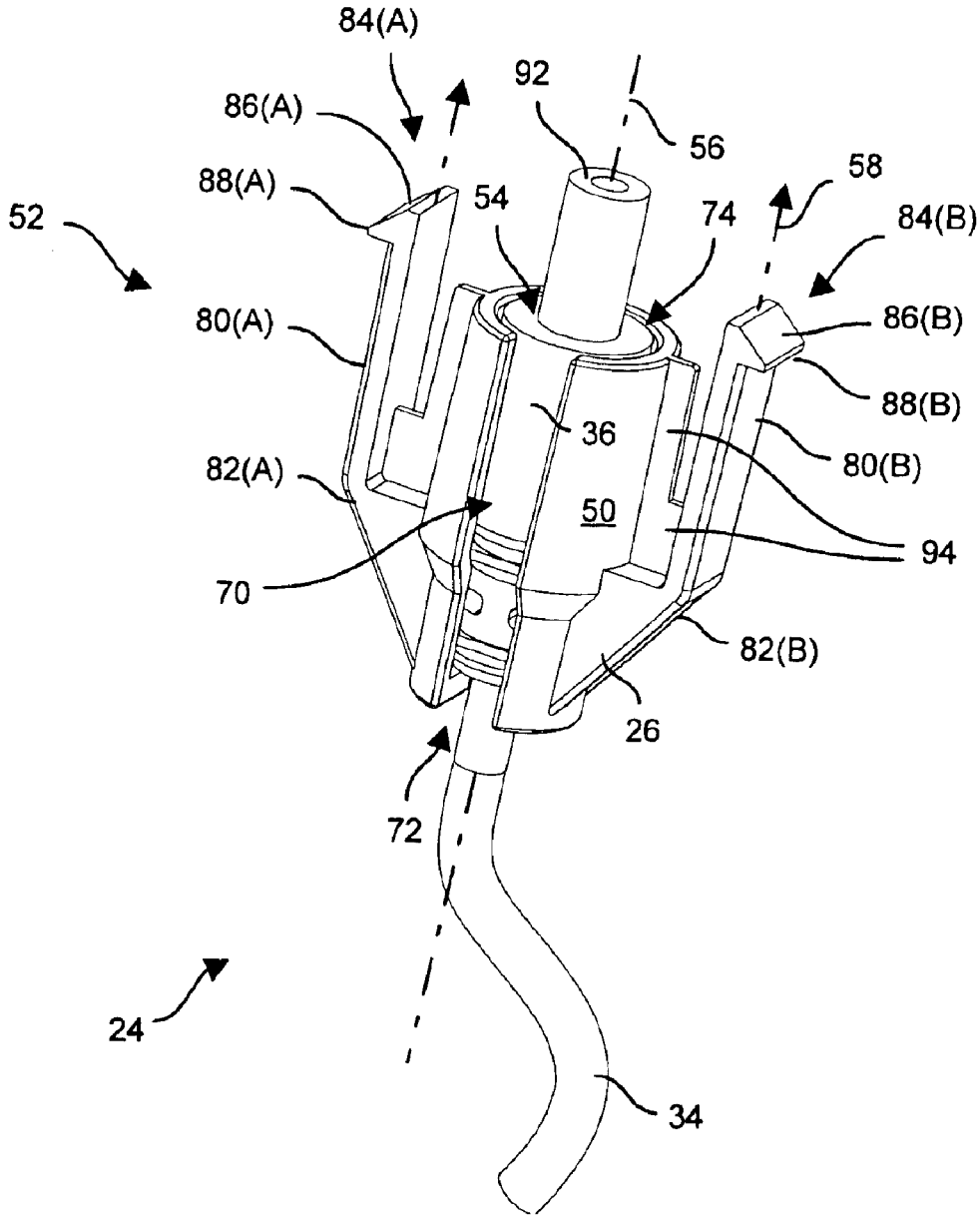
FIG. 4 is a perspective view of the retaining clip of FIG. 3 when holding a cable connector.

FIG. 3 is a detailed perspective view of the retaining clip 26. FIG. 4 shows the retaining clip 26 receiving and holding the cable connector 36 of the cable assembly 24. As shown in FIG. 3, the main body 50 of the retaining clip 26 defines, as the cavity 54, a substantially cylindrical space and the central axis 56 extends substantially through a center of this substantially cylindrical space. The main body 50 further defines a cable slot 70 that extends in a direction that is substantially parallel to the central axis 56 in a split-collar type configuration. In particular, the cable slot 70 extends along an entire length of the main body 50 from a cable aperture 72 at one end of the cavity 54 to a connector aperture 74 at the opposite end of the cavity 54. The cable slot 70 has a width 76 that allows the cable 34 of the cable assembly 24 to pass therethrough, but that prevents the cable connector 36 from passing therethrough.

As further shown in FIG. 3, the diameter 78 of the cavity 54 as well as the connector aperture 74, as measured through the central axis 56 is large enough to accommodate the cable connector 36. In particular, the various dimensions of the retaining clip 26 enable a user to slide the cable 34 through the cable slot 70, and subsequently slide the cable connector 36 into the cavity 54. As the cable connector 36 slides into the cavity 54, the user removes avoids cable slack within cavity 54 by passing the cable 34 through the cable aperture 72. Preferably, the cavity 54 defined by the main body 40 is dimensioned to provide a friction fit on the cable connector 36 of the cable assembly 24, e.g., a snug fit that still allows the main body 54 to (i) easily receive and hold the cable connector 36 into, but also (ii) release the cable connector 36 from the main body 40 should the user choose to remove the cable connector 36 from the main body 40 (see FIG. 4).

As shown in FIGS. 3 and 4, the width 76 of the cable slot 70 is substantially narrower than the diameter 78 of the cavity 54 thus enabling the cable 34 of the cable assembly 24 to pass therethrough, but inhibiting the cable connector 36 from falling out of the cavity 54 through the cable slot 70. Similarly, the cable aperture 72 is substantially narrower than the cavity diameter 78 thus allowing the cable 34 of the cable assembly 24 to pass therethrough, but inhibiting the cable connector 36 from exiting the cavity 54 through the cable aperture 72.

As further shown in FIGS. 3 and 4, there are two latching arms 52(A), 52(B) in the set of latching arms 52. The latching arms 52 are disposed on opposite sides of the main body 50, i.e., at 180 degrees from each around relative to the center axis 56. As will be explained in further detail later, such positioning of the latching arms 52 enables a user's hand to easily hold, maneuver and operate the retaining clip 26 (e.g., to compress the latching arms 52 together in order to detach the retaining clip 26 from the device 22 if desired).

As shown in FIG. 3, each latching arm 52(A), 52(B) includes a beam-shaped extending member 80(A), 80(B) having a first end 82(A), 82(B) which attaches to the main body 50 and a second end 84(A), 84(B). The extending members 80(A), 80(B) define ramped surfaces 86(A), 86(B) and latching portions 88(A), 88(B) at the second ends 84(A), 84(B).

As illustrated by the arrows 90(A), 90(B), the extending members 80(A), 80(B) have elasticity and are thus movable relative to the main body 50. In particular, the extending members 80(A), 80(B) are configured to deflect in radial directions 90(A), 90(B) toward the center axis 56 in response to force applied to the extending members 80(A), 80(B). For example, when a user's hand squeezes the extending members 80(A), 80(B) toward each other and toward the main body 50, the extending members 80(A), 80(B) bend toward each other resulting in inward movement of the second ends 84(A), 84(B) in the directions 90(A), 90(B). Similarly, when the user's hand releases the extending members 80(A), 80(B), resiliency within the extending members 80(A), 80(B) causes the extending members 80(A), 80(B) to bend back away from each other and away from the center axis 56 in directions opposite the directions 90(A), 90(B) thus resulting in the second ends 84(A), 84(B) returning to their original positions.

The main body 50 and the latching arms 52 (i.e., the extending members 80) of the retaining clip 26 are preferably formed of a non-conductive material (e.g., PC/ABS). In one arrangement, the main body 50 and the latching arms 52 are integrally formed of a solid, injection molded, resilient, non-conductive plastic (e.g., a low cost, mass production part). This arrangement enables the user to easily handle a unitary component, i.e., the retaining clip 26, without the need for awkwardly juggling multiple elements (e.g., hardware, small separate pieces, etc.). Rather, the user simply installs the cable connector 36 into the main body 50 of the retaining clip 26, and then connects both the cable connector 36 and the retaining clip 26 with the device 22. During connection, the user moves a connecting interface 92 (FIG. 4) of the cable connector 36 (e.g., coaxially arranged contacts of a coaxial power supply jack that extend out from the cable connector 36 in the direction 58 of the latching arms 52) toward a corresponding connecting interface of the device connector 30 (FIG. 1) until (i) the connectors 30, 36 mate and (ii) the retaining clip 26 secures with the rigid planar member 28 of the device 22 (e.g., in a snap fit manner). Furthermore, as shown in FIG. 3, support rails 94 along both the main body 50 and the extending members 80(A), 80(B) provide for sturdy and well-controlled actuation of the retaining clip 26 by inhibiting twisting, torquing and/or movement of the various retaining clip portions in undesired directions.

Additionally, the retaining clip 26 is sized and configured to fit within a user's hand to enable the user to subsequently grasp the retaining clip 26 in one hand, squeeze the latching arms 52 toward each other and toward the main body 50 to disengage the retaining clip 26 and the cable connector 36 from the device 22. In particular, as the user's hand compresses the latching arms 52 together, the latching portions 88(A), 88(B) at the ends 84(A), 84(B) move toward the central axis 56 and clear the sides of the apertures 60(A), 60(B) thus de-latching the retaining clip 26 from the rigid planar member 28. Preferably, during disconnection, friction between the retaining clip 26 and the cable connector 36 is high enough so that the cable connector 36 detaches from the device connector 30 as the user moves the retaining clip 26 away from the device 22. Further details of how the retaining clip 26 attaches to and detaches from the rigid planar member 28 will now be provided with reference to FIG. 5

Figure 5:
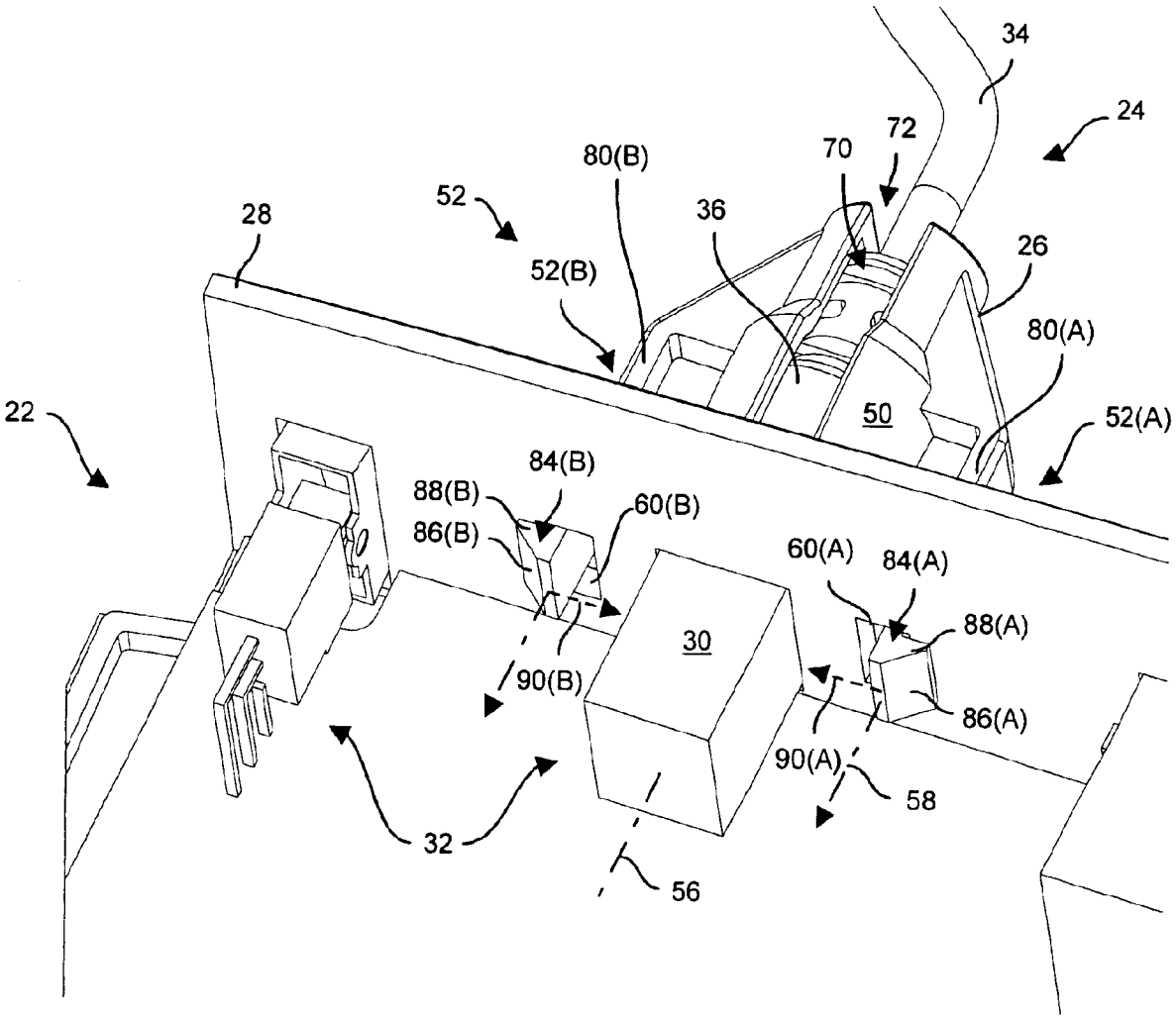
FIG. 5 is a perspective view of the connection system of which is similar to that of FIG. 2 but from a different angle.

FIG. 5 shows the cable assembly 24 and the retaining clip 26 robustly fastened to the device 22. As mentioned above, to attach the cable assembly 24 to the device 22, a user first installs the cable connector 36 of the cable assembly 24 into the retaining clip 26 (also see FIG. 4), and then moves both the cable connector 36 and the retaining clip 26 toward the device connector 30 in the direction 58 and along the central axis 56 defined by the retaining clip 26. As the tapered surfaces 86(A), 86(B) of the extending members 80(A), 80(B) push against the rigid planar member 28 of the device 22 near the apertures 60(A), 60(B), the extending members 80(A), 80(B) temporarily deflect in the respective radial directions 90(A), 90(B) toward the central axis 56 until the latching portions 88(A), 88(B) at the second ends 84(A), 84(B) of the extending members 80(A), 80(B) completely pass through the apertures 60(A), 60(B). At that point, the tapered surfaces 86(A), 86(B) clear the rigid planar member 28 thus allowing the ends 84(A), 84(B) to move radially outward in directions opposite the directions 90(A), 90B) back to their original distances from the central axis 56 due to resiliency in the extending members 80(A), 80(13). Accordingly, a robust interlocking, interference fit exists between the extending members 80(A), 80(B), i.e., the latching arms 52 of the retaining clip 26) thus holding the retaining clip 26 and the cable connector 36 reliably in an operating position relative to the device connector 30 of the device 22. As a result, the retaining clip 26 inhibits unintended disconnection of the cable connector 36 from the device connector 30. In particular, the retaining clip 26 prevents the cable connector 36 from inadvertently pulling out of the device connector 30 due to movement around the device 22, e.g., by a cleaning person.

After the cable assembly 24 and the retaining clip 26 are secured to the device 22 (see FIG. 5), the cable assembly 24 may need to be disconnected from the device 22 (e.g., if the device 22 is to be moved to another location, due to replacement of a damaged cable assembly 24, etc.). To remove the cable connector 36 from the device connector 30, the user grasps the retaining clip 26 and pinches the extending members 80(A), 80(B) toward each other. The ends 84(A), 84(B) of the extending members 80(A), 80(B) respond by moving toward the central axis 56 until the latching portions 88(A), 88(B) clear the sides of the rigid planar member 28 and fully align with the apertures 60(A), 60(B). The user then pulls the retaining clip 26 in the direction opposite the direction 58 and away from the device 22. The cable connector 36 which is held by the retaining clip 26 due to a friction fit within the main body 50, then un-mates from the device connector 30. Further details of the invention will now be provided with reference to FIG. 6.

Figure 6:
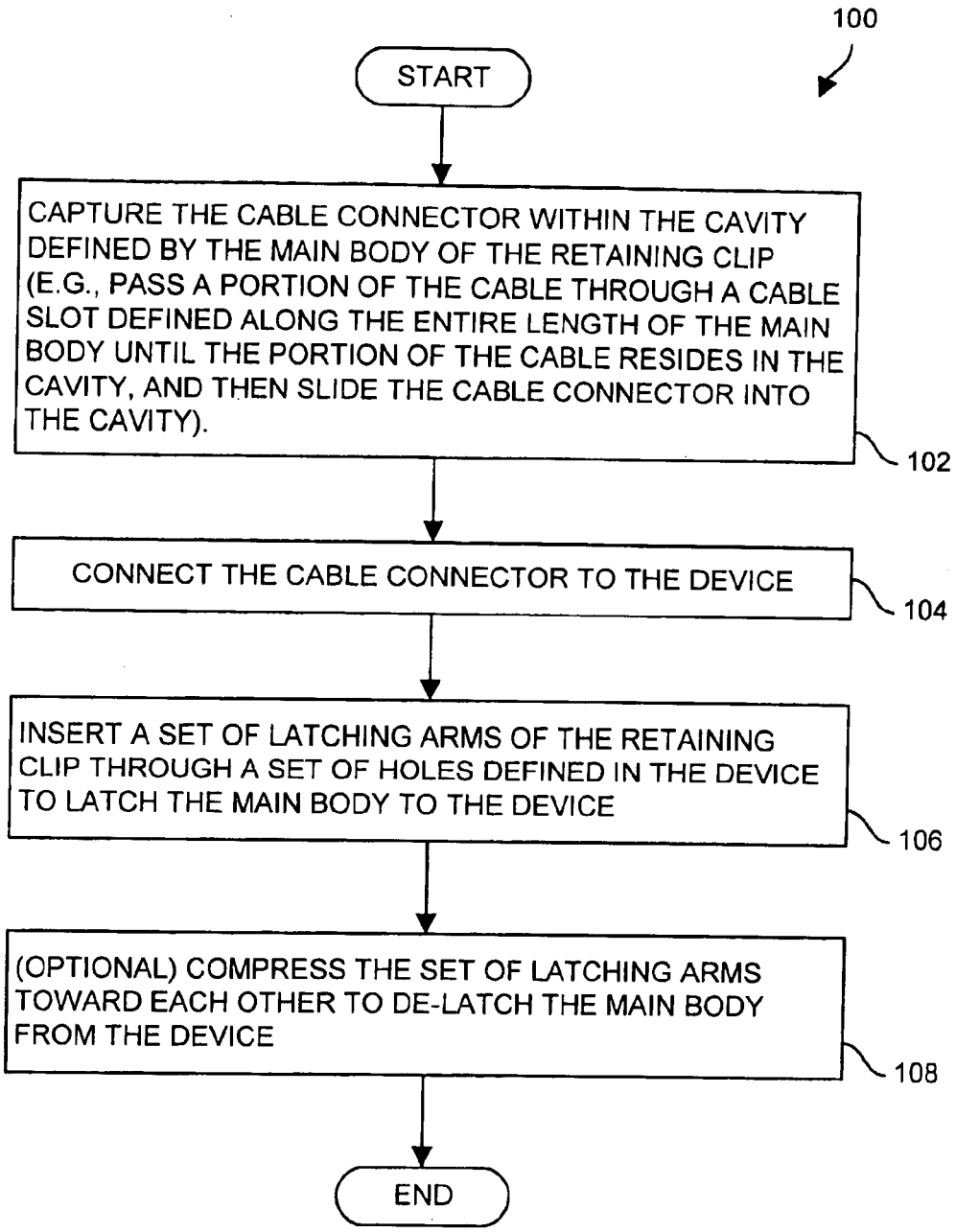
FIG. 6 is a flowchart of a procedure for using the retaining clip of FIG. 2.

FIG. 6 is a flowchart of a procedure 100 summarizing the operation of the retaining clip 26. In step 102, the user captures the cable connector 36 of the cable assembly 24 within the cavity 54 defined by the main body 50 of the retaining clip 26 (also see FIG. 4). In particular, the user slides the cable 34 of the cable assembly 24 through the cable slot 70, and then inserts the cable connector 36 into the cavity 54. The user allows slack of the cable 34 to pass through the cable aperture 72 until the main body 50 receives and holds the cable connector 36 a friction fit manner.

In step 104, the user connects the cable connector 36 to the device 22. Here, the user maneuvers the retaining clip 26 toward the device 22 in the direction 58 (FIG. 1). In particular, the user guides the contacts 92 of the cable connector 36 (FIG. 4) toward the device connector 30 so that the two connectors 30, 36 begin to mate with each other, and so that the latching arms 52 of the retaining clip 26 align with and insert through the apertures 60(A), 60(B), e.g., rectangular holes defined in the rigid planar member 28 (Fig. 1).

In step 106, the user continues moving the latching arms 52 through the apertures 60(A), 60(B) until the retaining clip 26 latches with the device 22 (e.g., until the latching arms 52 of the retaining clip 26 snap back thus providing audio feedback to the user). At this point, there is interlocking interference between the retaining clip 26 and the rigid planar member 28 thus robustly and reliably securing the cable connector 36 to the device connector 30 (FIGS. 2 and 5).

In step 108, the user optionally detaches the cable connector 36 from the device connector 30 (e.g., when moving the device 22 to a new location). In particular, the user compresses the latching arms 52 toward each other thus de-latching the retaining clip 26 and the cable connector 26, which is held within the main body 50 of the retaining clip 26, from the device 22.

As mentioned above, embodiments of the invention are directed to techniques for securing a cable connector 36 to a device 22 using a retaining clip 26. The use of such a retaining clip 26 enables an equipment manufacturer to provide devices 22 with external cable assemblies 24 so that the user can secure cable connectors 36 of the external cable assemblies 24 to the devices 22 without concern that the cable connectors 36 will inadvertently disconnect from the devices 22. Moreover, the cable assembly 24 is separate from the device 22 thus alleviating the need for the manufacturer to incur additional installation and testing costs that are typically associated with the use of internal power supplies, i.e., the manufacturer avoids the costs of installing and testing the internal power supplies. Additionally, the manufacturer has the flexibility of simply including pre-tested, off-the-shelf external power supplies and the associated cost benefits of this approach such as purchasing the external power supplies and cable assemblies 24 from the source that provides the manufacturer with best deal or terms.

While this invention has been particularly shown and described with references to preferred embodiments thereof, it will be understood by those skilled in the art that various changes in form and details may be made therein without departing from the spirit and scope of the invention as defined by the appended claims.

For example, it should be understood that the device 22 was described above as being a data communications device (a network router, a bridge, a hub, etc.) for illustration purposes only. In this context, there should be little concern about losing power to the device 22 that would otherwise result in lost data and or lost network availability due to inadvertent disconnection of the cable connector 36 from the device connector 30 since the cable connector 36 is reliably held in place by the retaining clip 26.

Additionally, in other arrangements, the device 22 is equipment other than data communications equipment such as a general purpose computer, specialized electronic equipment, etc. Moreover, the retaining clip 26 is well-suited for holding any type of connector to any kind of device. For instance, the retaining clip 26 is well-suited for any kind of power supply jack, or other signal carrying connector (e.g., a MiniDin mouse connector, a non-coaxial connector, a printer connector, a USB connector, general signal connectors, and the like). To this end, it should be understood that the cavity 54 was described above as being substantially cylindrical in shape by way of example only to accommodate a standard coaxial style power supply jack. It should be further understood that, in some other arrangements which use non-cylindrical cable connectors, the cavity 54 is non-cylindrical in shape as well. In these arrangements, the cavity 54 substantially matches the shape of the non-cylindrical cable connector. For example, in one arrangement, the cable assembly 24 includes a rectangular-shaped USB connector, and the retaining clip 26 defines a rectangular-shaped cavity 54 which substantially matches the shape of the rectangular-shaped USB connector.

Furthermore, it should be understood that the cable slot 70 was described above as being substantially parallel and straight relative to the central axis 56 by way of example only to enable a user to easily insert (and/or perhaps later remove) the cable 34. In other arrangements, the cable slot 70 is not substantially parallel to the central axis 56. For example, in some arrangements, the cable slot is zigzagged in shape to make it more difficult for the cable 34 in inadvertently slip out of the cavity 54 when the user installs the cable connector 36 within the retaining clip 26.

Additionally, it should be understood that the cable slot 70 was conveniently positioned at 90 degrees between two 180 degree oriented latching arms 52 so that the cable slot 70 is easy for the user to find along the main body 50. Nevertheless, other configurations are suitable for use by the retaining clip 26 as well. In one arrangement, the cable slot 70 is offset at an angle other than 90 degrees to better hide the cable 34 from view. Moreover, in other arrangements, the retaining clip 52 has a number of latching arms 52 other than two, e.g., one latching arm 52 for easier access to the main body 50, three or more latching arms 52 to improve attachment of the retaining clip 26 with the device 22.

Furthermore, it should be understood that each latching arm 52 of the retaining clip 26 was described above as extending in a direction 58 which is substantially parallel to the central axis 56 by way of example only for a simple and practical design. In other arrangements, the latching arms 52 extend in other directions. For example, in some arrangements, the latching arms 52 extend in directions which are not substantially parallel to the central axis 56.

Additionally, it should be understood that the main body 50 of the retaining clip 26 was shown as holding an in-line cable connector by way of example only and that other types of connectors are suitable for use by the invention. In some arrangements, the main body 50 is configured to hold a right-angle (e.g., a 90 degree) connector.

Furthermore, it should be understood that the order of steps of the procedure 100 was provided by way of example only. In other arrangements, the order of the steps is different. For example, in one arrangement, step 104 occurs before step 102. That is, the user initially connects the cable connector 36 (FIG. 1) to the device 22 (step 104), and subsequently installs the retaining clip 26 over the cable connector 36 (step 102). As another example, in another arrangement, the user inserts a portion of the cable 34 through the retaining clip 26, then connects the cable connector 36 to the device connector 30, and finally fits the retaining clip 26 over the cable connector 36 and attaches the retaining clip 26 to the device 22 thus essentially performing steps 102 and 104 currently. Such modifications and enhancements are intended to belong to various embodiments of the invention.

What is claimed is:

1. A connection system, comprising:

a device;

a cable assembly having a cable and a cable connector disposed at an end of the cable, the cable connector being configured to connect to the device; and a retaining clip configured to secure the cable connector to the device when the cable connector connects to the device, the retaining clip including:

a main body defining a cavity and a central axis which extends through the cavity, the main body being configured to receive and hold the cable connector, and a set of latching arms attached to the main body, each latching arm extending in a direction substantially parallel to the central axis and being configured to latch the main body to the device when the main body receives and holds the cable connector and when the cable connector connects to the device;

wherein the main body defines a cable slot that extends (i) in a direction that is substantially parallel to the central axis, and (ii) along an entire length of the main body to enable the main body to receive and hold the cable connector.

2. The connection system of claim 1 wherein the set of latching arms includes:

multiple extending members, each extending member having a first end which attaches to the main body and a second end which is configured to grasp the device when latching the main body to the device.

3. The connection system of claim 2 wherein the multiple extending members include:

a first extending member, and a second extending member, the first and second extending members being disposed on opposite sides of the main body to facilitate simultaneous deflection of the first and second extending members toward the main body and toward each other in response to compression by a user's hand when de-latching the main body from the device.

4. The connection system of claim 1 wherein the cavity defined by the main body has a cavity diameter, and wherein the cable slot defined by the main body is substantially smaller than the cavity diameter.

5. The connection system of claim 1 wherein the main body defines, as the cavity, a substantially cylindrical space; and wherein the central axis extends substantially through a center of the substantially cylindrical space.

6. The connection system of claim 5, wherein the main body further defines a cable aperture at one end of the substantially cylindrical space, and wherein the cable aperture has a diameter that is narrower than that of the substantially cylindrical space.

7. The connection system of claim 1 wherein the cable assembly further includes a DC transformer connected to the cable, wherein the cable connector is a coaxial power supply jack, and wherein the main body of the retaining clip is configured to slide around and capture the coaxial power supply jack.

8. A retaining dip for securing a cable connector to a device when the cable connector connects to the device, the retaining clip comprising:

a main body defining a cavity and a central axis which extends through the cavity, the main body being configured to receive and hold the cable connector; and a set of latching arms attached to the main body, each latching arm extending in a direction substantially parallel to the central axis and being configured to latch the main body to the device when the main body receives and holds the cable connector and when the cable connector connects to the device:

wherein the main body defines a cable slot that extends (i) in a direction that is substantially parallel to the central axis, and (ii) alone an entire length of the main body to enable the main body to receive and hold the cable connector.

9. The retaining clip of claim 8 wherein the set of latching arms includes:

multiple extending members, each extending member having a first end which attaches to the main body and a second end which is configured to grasp the device when latching the main body to the device.

10. The retaining clip of claim 9 wherein the multiple extending members include:

a first extending member; and a second extending member, the first and second extending members being disposed on opposite sides of the main body to facilitate simultaneous deflection of the first and second extending members toward the main body and toward each other in response to compression by a user's hand when de-latching the main body from the device.

11. The retaining clip of claim 8 wherein the cavity defined by the main body has a cavity diameter, and wherein the cable slot defined by the main body is substantially smaller than the cavity diameter.

12. The retaining clip of claim 8 wherein the main body defines, as the cavity, a substantially cylindrical space; and wherein the central axis extends substantially through a center of the substantially cylindrical space.

13. The retaining clip of claim 12 wherein the main body further defines a cable aperture at one end of the substantially cylindrical space, and wherein the cable aperture has a diameter that is narrower than that of the substantially cylindrical space.

14. The retaining clip of claim 13 wherein the main body further defines an interface aperture at another end of the substantially cylindrical space, wherein the interface aperture has a diameter that is at least as wide as that of the substantially cylindrical space, and wherein each latching arm extends from the main body and along the substantially cylindrical space in a direction toward the interface aperture.

15. The retaining clip of claim 8 wherein the main body and the set of latching arms are integrally formed of a solid, injection molded, non-conductive material.

16. A method for using a retaining clip which is adapted to secure a cable connector to a device, the method comprising:

capturing the cable connector within a cavity defined by a main body of a retaining clip;

connecting the cable connector to the device; and inserting a set of latching arms of the retaining clip through a set of holes defined in the device to latch the main body to the device, the set of latching arms being attached to a main body of the retaining clip, each latching arm extending in a direction substantially parallel to a central axis defined by the main body and being configured to latch the main body to the device when the main body receives and holds the cable connector and when the cable connector connects to the device;

wherein the main body defines a cable slot that extends (i) in a direction that is substantially parallel to the central axis, and (ii) along an entire length of the main body to enable the main body to receive and hold the cable connector.

17. The method of claim 16, further comprising:

compressing the set of latching arms toward each other to de-latch the main body from the device.

18. The method of claim 16 wherein the cable connector is disposed at an end of a cable, and wherein capturing the cable connecting within the cavity defined by the main body of the retaining clip includes:

passing a portion of the cable through the cable slot defined along an entire length of the main body of the retaining clip until the portion of the cable resides in the cavity defined by the main body of the retaining clip; and sliding the cable connector into the cavity defined by the main body of the retaining clip.

19. The connection system of claim 1 wherein each latching arm is configured to remain outside of the cavity defined by the main body during actuation.

20. The connection system of claim 19, further comprising:

a set of support rails coupled to the main body and to the set of latching arms, the set of support rails being configured to inhibit twisting movement of the set of latching arms during actuation.

21. The connection system of claim 19 wherein each latching arm defines a tapered end which deflects toward the main body in response to contact with device.

22. The retaining clip of claim 8 wherein each latching arm is configured to remain outside of the cavity defined by the main body during actuation.

23. The retaining clip of claim 22, further comprising:

a set of support rails coupled to the main body and to the set of latching arms, the set of support rails being configured to inhibit twisting movement of the set of latching arms during actuation.

24. The retaining clip of claim 22 wherein each latching arm defines a tapered end which deflects toward the main body in response to contact with device.

25. The method of claim 16, wherein inserting the set of latching arms includes:

actuating the set of latching arms while set of latching arms remain outside of the cavity defined by the main body.

26. The method of claim 25 wherein actuating the set of latching arms includes:

receiving stabilization from a set of support rails coupled to the main body and to the set of latching arms, the set of support rails inhibit twisting movement of the set of latching arms during actuation.

27. The method of claim 25 wherein the latching arms define tapered ends, and wherein actuating includes:

moving the retaining clip toward the device to deflect the tapered ends of the latching arms toward the main body in response to contact the tapered ends and the device.

* * * * *

UNITED STATES PATENT AND TRADEMARK OFFICE

CERTIFICATE OF CORRECTION

PATENT NO. : 6,939,161 B1
DATED : September 6, 2005
INVENTOR(S) : George Youzhi Yi and Tracy Winn It is certified that error appears in the above-identified patent and that said Letters Patent is hereby corrected as shown below:

Column 10,
Line 49, "5," should read -- 5 --.
Line 60, "dip" should read -- clip --.

Column 12,
Line 45, "16," should read -- 16 --.

Signed and Sealed this

Twentieth Day of December, 2005

JON W. DUDAS
*Director of the United States Patent and Trademark Office*